United States Patent [19]

Russell

[11] 3,967,338

[45] July 6, 1976

[54] BRUSH ASSEMBLY

[76] Inventor: Marty M. Russell, 254 N. Clark Drive, Beverly Hills, Calif. 90211

[22] Filed: June 30, 1975

[21] Appl. No.: 591,658

[52] U.S. Cl. ..... 15/185; 15/203
[51] Int. Cl.[2] ..... A46B 9/02
[58] Field of Search ..... 15/159, 184, 185, 201, 15/203

[56] References Cited

UNITED STATES PATENTS

| | | | |
|---|---|---|---|
| 1,391,783 | 9/1921 | McDermott et al. | 15/185 X |
| 1,770,344 | 7/1930 | Schmidt | 15/185 |
| 2,774,096 | 12/1956 | Taylor | 15/203 |

*Primary Examiner*—Peter Feldman
*Attorney, Agent, or Firm*—Keith D. Beecher

[57] ABSTRACT

An inexpensive sanitary hairbrush assembly is provided which is equipped with a cover that hinges down over the bristles of the brush when the brush is not in use bending the bristles down into the plane of the base, so as to provide a compact enclosure for the bristles, thereby permitting the brush to be carried in a purse, handbag, pocket, or the like, without exposure of the bristles; and in which the cover serves as a handle for the brush when it is opened.

2 Claims, 3 Drawing Figures

BRUSH ASSEMBLY

BACKGROUND OF THE INVENTION

Hairbrushes have been in general use for many centuries, and are formed by setting bristles in an upright position in a base. The base is usually made of wood, metal, rubber, plastic, or the like. Recently brush bristles have been made of resilient synthetic materials, such as nylon, which are of a nature that they can be bent down into the plane of the base, but will snap back to an upright position when the bending pressure is removed.

There has been a general reluctance for persons to carry hairbrushes around with them because the exposed bristles can become soiled and dirty, and can create sanitary problems. Assemblies have been provided in the prior art with covers to protect the brush when not in use. However, the prior art assemblies have been unduly bulky, expensive and complex and, for that reason, have failed to gain any significant commercial acceptance.

In accordance with the present invention, a simple and inexpensive assembly is provided which includes a cover that may be turned down over the bristles of the brush when the brush is not in use, to bend the bristles down into the plane of the base which supports the bristles. Resilient, synthetic bristles, formed of nylon, or the like, are used, and the resulting assembly is particularly compact since the cover may be turned down over the bristles causing the bristles to bend over, and yet the bristles will spring back to their original upright position when the cover is opened. The cover also serves as a handle for the brush when it is in its open position.

DETAILED DESCRIPTION OF THE ILLUSTRATED EMBODIMENT

The illustrated brush assembly includes a base 10 having a plurality of bristles 12 mounted thereon in an upright position. The bristles 12 may, for example, be formed of nylon, or other appropriate synthetic material, so as to have a high degree of resilience.

Figure 1:
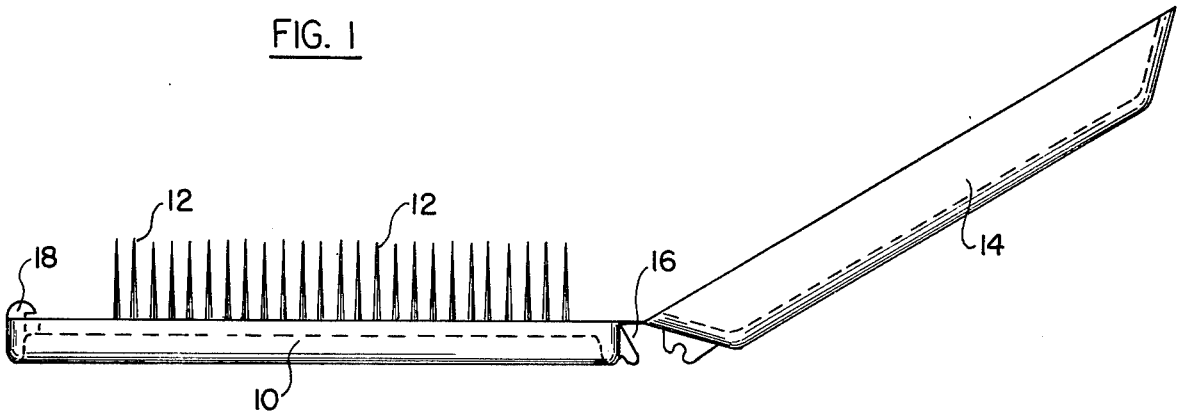
FIG. 1 is a side elevation of a brush assembly constructed in accordance with one embodiment of the invention, and including a cover, the cover being shown in an open position in the embodiment of FIG. 1.
Figure 2:
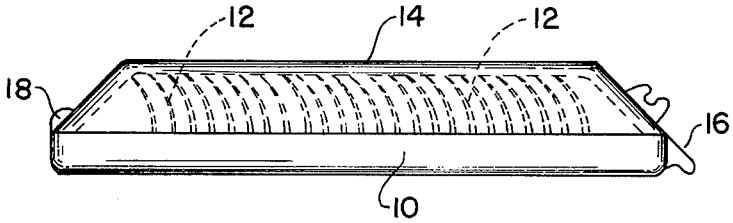
FIG. 2 is a side elevation of the brush assembly of FIG. 1, with the cover in a closed position.
Figure 3:
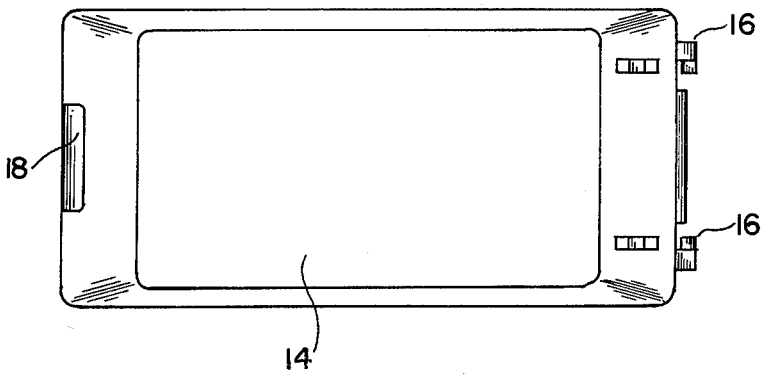
FIG. 3 is a top plan view of the assembly, likewise with the cover in a closed position.

A cover 14 is hinged to the base 10 by means of a hinge 16, and the cover 14 may be turned down from the open position of FIG. 1 ot a closed position, such as shown in FIGS. 2 and 3 in which it covers and completely encloses the bristles 12. An appropriate latch 18 is provided to hold the cover 14 in its closed position. The cover 14 causes the bristles to bend over as it is closed, as shown in FIG. 2. The bristles are formed of a synthetic resilient material, such as nylon, for example, so that when the cover is opened, the bristles spring back to their upright position. The cover serves as a handle for the brush when in its open position.

It will be appreciated that while the brush assembly of the invention has been described in conjunction with hairbrushes, covers may be provided for other types of brushes, for the same purpose.

Therefore, although a particular embodiment of the invention has been shown and described, it is evident that modifications may be made. The following claims are intended to cover all modifications which come within the spirit and scope of the invention.

What is claimed is:

1. A brush assembly including: a one-piece base member; a plurality of bristles formed of resilient synthetic material set in the base member in a perpendicular upright position thereon; and a one-piece flat cover mounted on the base member and movable between an open position and a closed position to enclose the bristles when the brush assembly is not in use, said cover being in sufficiently close proximity with the upper ends of the bristles when in its closed position to cause the bristles to bend over from their upright position into the plane of the base member, and the cover being shaped to form a handle for the brush when in its open position.

2. The brush assembly defined in claim 1, and which includes hinge means attaching the cover to the base member.

* * * * *